United States Patent [19]

Fujita et al.

[11] Patent Number: 4,701,246

[45] Date of Patent: Oct. 20, 1987

[54] METHOD FOR PRODUCTION OF DECONTAMINATING LIQUID

[75] Inventors: Reiko Fujita, Kamakura; Masami Enda, Yokohama, both of Japan

[73] Assignee: Kabushiki Kaisha Toshiba, Kawasaki, Japan

[21] Appl. No.: 836,985

[22] Filed: Mar. 6, 1986

[30] Foreign Application Priority Data

Mar. 7, 1985 [JP] Japan ..... 60-45647
Mar. 7, 1985 [JP] Japan ..... 60-45648

[51] Int. Cl.[4] ..... C25F 5/00

[52] U.S. Cl. ..... 204/130; 204/86; 204/89; 204/141.5; 252/626

[58] Field of Search ..... 204/86, 140, 84, 141.5, 204/130; 252/626

[56] References Cited

U.S. PATENT DOCUMENTS 3,682,796 8/1972 Bedi et al. ..... 204/89
4,162,229 7/1979 Loewenschuss ..... 252/626
4,243,501 1/1981 Wright, Jr. ..... 204/89
4,273,628 6/1981 Kidon et al. ..... 204/87
4,470,951 9/1984 Bradbury et al. ..... 252/626

*Primary Examiner*—R. L. Andrews
*Attorney, Agent, or Firm*—Finnegan, Henderson, Farabow, Garrett & Dunner

[57] ABSTRACT

A decontaminating liquid capable of removing a radioactive substance adhering to or deposited in a metal waste is produced by a method which comprises immersing an anode made of a metal or a metal oxide having a high oxygen overvoltage equal to or higher than the oxygen overvoltage of platinum and a cathode made of a metal or a metal oxide having a low hydrogen overvoltage equal to or lower than the hydrogen overvoltage of platinum in an acidic solution having dissolved therein a metal ion in a low-oxidation state and causing passage of an electric current between the two electrodes thereby giving rise to a metal ion in a high-oxidation state.

15 Claims, 2 Drawing Figures

METHOD FOR PRODUCTION OF DECONTAMINATING LIQUID

The present Application claims priority of Japanese Patent Application Ser. No. 60-45647 and No. 60-45648 filed respectively on Mar. 7, 1985.

BACKGROUND OF THE INVENTION

This invention relates to a method for the production of a decontaminating liquid for removing radioactive substance adhering to or deposited on the surface of a radioactive metal waste which is generated from nuclear power generation facilities and nuclear fuel recycling facilities.

Radioactive oxide layers form inside pipes, machines and vessels, fuel assemblies, etc. which have been used in nuclear power generation facilities and nuclear fuel recycling facilities. They constitute themselves a cause for increasing the surface dose rate. Removal of these oxide layers from the aforementioned mechanical articles, i.e. decontamination of the mechanical articles, therefore, is indispensable for the purpose of decreasing the possibility of attendants being exposed to radiation as during the course of a periodic inspection. Generally in this removal, the oxide layers formed on the surface of metal materials, corrosion products resulting from dissolution, adhesion, or sedimentation of matrix metal materials, and nuclear fission products are required to be shed into a liquid. Various methods which are now available for the contamination of the nature just mentioned may be broadly divided into chemical methods of decontamination, physical methods of decontamination inclusive of mechanical methods, and electrochemical methods of decontamination. The chemical methods resort to use of a decontaminating agent formed by blending an oxidation-reduction agent, a complexing agent, and an inhibitor with due respect to the characteristic properties of the oxide layers. These methods are advantageous in terms of the speed of solution of oxide layers but entail the disadvantage of giving rise to a large volume of a secondary waste.

As means of overcoming the drawback, the specification of U.S. Pat. No. 4,217,192, for example, discloses a process for the decontamination of metals contaminated by radiation in the nuclear power industry and a system therefore, which make use of chemical etching.

This is a chemical etching process utilizing an oxidation-reduction effect, which process comprises immersing a metal article subjected to contamination and a pair of electrodes intended for regeneration of an exhausted electrolyte together in an electrolyte (decontaminating liquid) formed from a nitric acid solution containing trivalent cerium ion and tetravalent cerium ion and held in a vessel thereby depriving the metal article of contaminating radiation, cleaning the decontaminated metal article, and removing the cleaned metal article out of the electrolyte.

In accordance with the process described above, however, the electric current for the formation of the tetravelent cerium ion is defined as falling in the range of 0.5 to 1.5 A and a decontaminating liquid consisting of 0.01 to 0.3 mol/liter of tetravalent cerium ion and 1 to 8 mol/liter of nitric acid is produced but the conditions of electrolysis for the formation of the tetravalent cerium ion are not clearly indicated. The inventors have had it experimentally ascertained that when the electric current falls in the aforementioned range of 0.5 to 1.5 A, and a different material for the cathode is used, a reaction causing reduction of tetravalent cerium ion to trivalent cerium ion occurs in the place of a reaction producing hydrogen at the cathode and, as a result, the electric current forming efficiency of the tetravalent cerium ion is degraded in efficiency. Similarly, in the aforementioned range of 0.5 to 1.5 A, and when a different material for the anode is used, a reaction causing oxidation of trivalent cerium ion to tetravalent cerium ion occurs in the place of a reaction producing oxygen at the anode; as a result, the elecric current forming the tetravelent cerium ion is degraded in efficiency. The decontamination step does not embrace any treatment for the separation of insoluble substances sedimented or suspended in the decontaminating liquid which has been spent in contamination. In the electrolyte (decontaminating liquid), therefore, the debris arising from the etching work gradually collects in the vessel to form a slurry or suspension and grows worse with the consumption of the electrolyte, preventing the electrolyte from filling its part satisfactorily and shortening the service life of the electrolyte.

Further, since this process consists in a batchwise operation and not in a continuous operation, it requires time and labor in preparation for each batch of operation and inevitably lengthens the total period of exposure of workers to radiation. Besides, since the process requires use of strong nitric acid and elevated temperatures, it entails generation of sulfur dioxide gas and nitric acid mist and consequent deterioration of the work environment. In the circumstances, the desirability of developing a method for the production of a decontaminating liquid which enjoys high current efficiency, permits continuous regeneration, and avoids heavily yielding secondary waste has been finding growing recognition.

SUMMARY OF THE INVENTION

The first object of this invention is to provide a method for the production of a decontaminating liquid which can be practically used for the purpose of oxidizing a metal ion in a low-oxidation state into a metal ion in a high-oxidation state at the anode with high efficiency.

The second object of this invention is to provide a method for the production of a decontaminating liquid which is capable of efficiently oxidizing and regenerating a reduced metal ion in a low-oxidation state resulting from the aforementioned decontamination of a contaminated metal material into a metal ion in a high-oxidation state and decreasing the occurrence of secondary waste by permitting re-use of the decontaminating liquid.

To attain the first object described above, the method contemplated by the present invention for the production of a decontaminating liquid is characterized by involving an electrolyzing step which comprises immersing an anode made of a metal having a high oxygen overvoltage equal to or higher than the oxygen overvoltage of platinum and a cathode made of metal or a metal oxide having a low hydrogen overvoltage equal to or lower than the hydrogen overvoltage of platinum in an oxidative solution obtained by dissolving a compound in a low-oxidation state of a metal assuming a high-oxidation state in an aqueous solution and causing passage of an electric current between the two electrodes thereby effecting oxidation of a metal ion in a low-oxidation state and consequent formation of a metal ion in a high-oxidation state at the aforementioned anode. To attain the second object described above, the process contemplated by the present invention for the production of a decontaminating liquid is characterized by comprising a decontaminating step of causing a radiation-contaminated metal material to contact the decontaminating liquid produced during the aforementioned electrolyzing step thereby dissolving a contaminating substance adhering to the contaminated metal material and the surface layer of a matrix metal material by virture of the oxidative force generated during the conversion of the metal ion in the high-oxidation state into a metal ion in a low-oxidation state, a separating step of separating insoluble substances sedimented or suspended in the used decontamination liquid which has effected removal of the decontaminating substance during the decontamination step, and a regenerating step of returning the decontaminating liquid containing the metal ion in a low-oxidation state and the metal ion in a high-oxidation state separated during the separating step back to the aforementioned electrolyzing step, immersing an anode made of a metal or a metal oxide having a high oxygen overvoltage equal to or higher than the oxygen overvoltage of platinum and a cathode made of a metal or a metal oxide having a low hydrogen overvoltage equal to or lower than the hydrogen overvoltage of platinum in the returned decontaminating liquid, and causing passage of an electric current between the electrodes thereby oxidizing and regenerating a metal ion in a low-oxidation state into a metal ion in a high-oxidation state at the aforementioned anode.

DETAILED DESCRIPTION OF THE INVENTION

Now, a working example of the method of this invention for the production of a decontaminating liquid will be described below with reference to the accompanying drawings.

Figure 1:
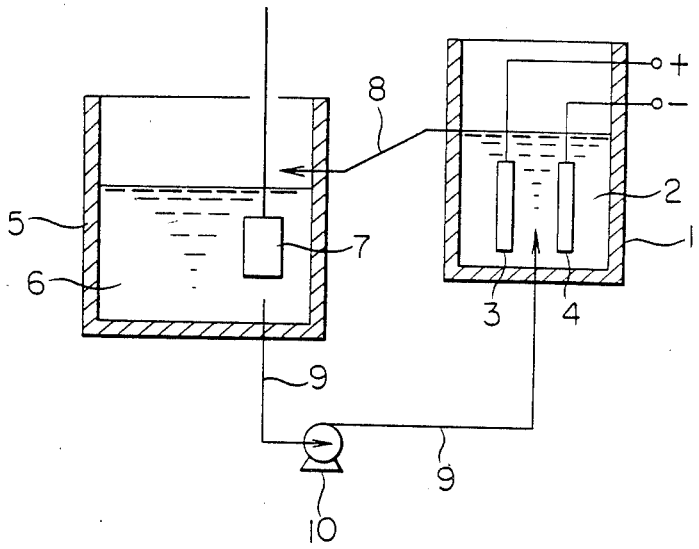
FIG. 1 is a system diagram illustrating a typical layout of an apparatus suitable for the accomplishment of the first object of the present invention and FIG. 2 is a block diagram illustrating a working example for accomplishing the second object of this invention.

FIG. 1 is a system diagram illustrating a typical layout of an apparatus suitable for working the method constituting the first object of this invention.

In this diagram, numeral 1 denotes an electrolytic cell. In this electrolytic cell 1, an oxidative solution having a metal ion in a low-oxidation state dissolved therein is stored. In the oxidative solution 2 which has the metal compound in a low-oxidation state dissolved therein, an anode 3 made of a metal or a metal oxide having a high oxygen overvoltage equal to or higher than the oxygen overvoltage of platinum and a cathode 4 made of a metal or a metal oxide having a low hydrogen overvoltage equal to or lower than the hydrogen overvoltage of platinum are immersed. Then, a voltage is applied at a prescribed current density between the two electrodes. In the diagram, numeral 5 denotes a decontaminating cell. In this decontaminating cell is stored a decontaminating liquid 6, i.e. an acidic solution which has dissolved therein a metal ion in a high-oxidation state produced in the aforementioned electrolytic cell 1 by the electrolysis of the acidic solution 2 containing a metal ion in a low-oxidation state. In the decontaminating liquid 6 having dissolved therein the aforementioned metal ion in a high-oxidation state, there is immersed an object of decontamination 7, i.e. a metal article contaminated by radioactive substance. The decontaminating cell 5 and the aforementined electrolytic cell 1 are interconnected with circulating pipes 8 and 9. The circulating pipe 9 is provided halfway along the length thereof with a circulating pump 10. In the piping system, the acidic solution 2 having dissolved therein the metal ion in a low-oxidation state and the decontaminating liquid 6 having dissolved therein the metal ion in a high-oxidation state are circulated between the electrolytic cell 1 and the decontaminating cell 5.

Figure 2:
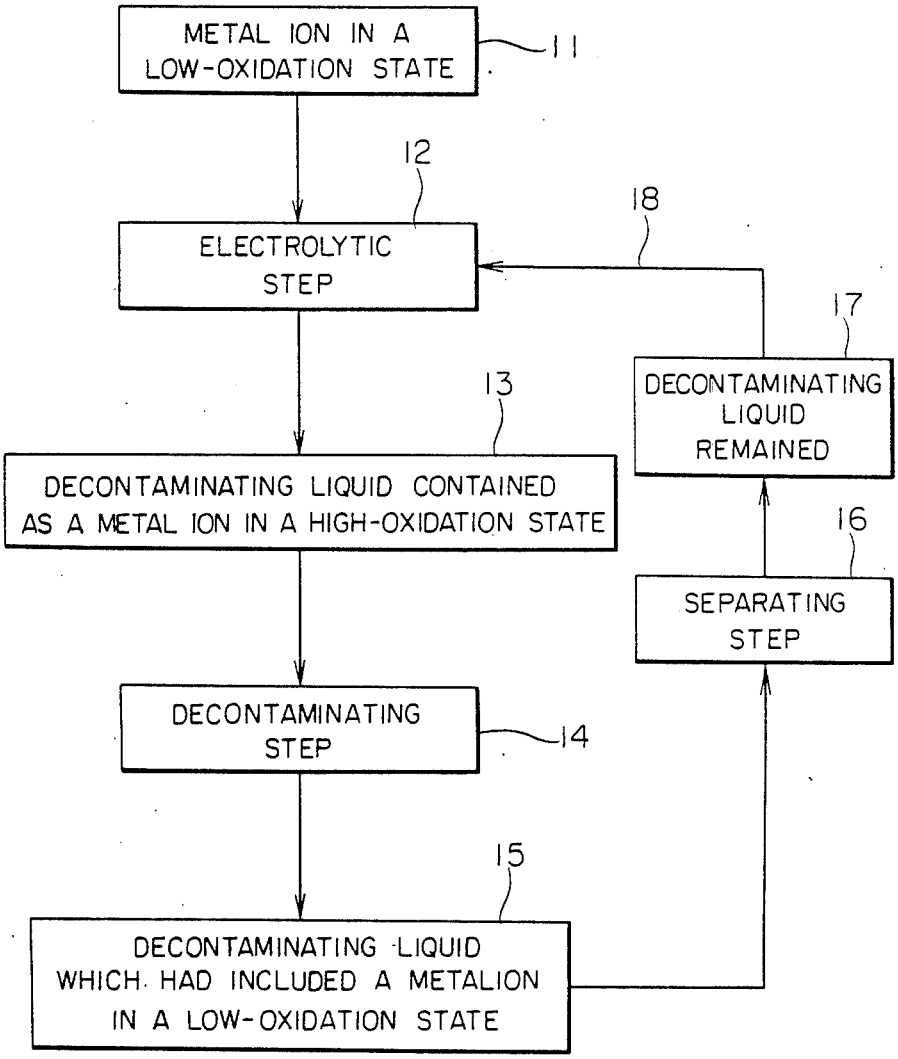

FIG. 2 is a block diagram for illustrating the method of the second object of this invention.

To be specific, this aspect of the present invention, as illustrated in the diagram, comprises an electrolyzing step 12 for converting a metal ion 11 in a low-oxidation state into a metal ion in a high-oxidation state, a decontaminating step 14 for decontaminating a contaminated metal material with a decontaminating liquid 13 containing therein a metal in a high-oxidation state formed in the electrolytic step 12, a separating step for separating radioactive insoluble substances from a used decontaminating liquid 15 containing therein the metal ion in a low-oxidation state produced by reduction in the aforementioned decontaminating step 14, and a regenerating step 18 for returning the decontaminating liquid 17 separated in the separating step 16 back to the aforementioned electrolytic step 12.

In the electrolytic step 12, an anode made of a metal or a metal oxide having a high oxygen overvoltage equal to or higher than the oxygen overvoltage of platinum and a cathode made of a metal or a metal oxide having a low hydrogen overvoltage equal to or lower than the hydogen overvoltage of platinum are immersed in an oxidative solution (decontaminating liquid) having dissolved therein a metal ion in a low-oxidation state and a voltage of a prescribed current density is applied between the two electrodes to produce a metal ion in a high-oxidation state. Then, in the decontamination step 14, after the metal ion in the high-oxidation state has grown to a prescribed concentration, the radiation-contaminated metal material to be decontaminated is immersed in the decontaminating liquid having dissolved therein both the metal ion in a low-oxidation state and the metal ion in a high-oxidation state to dissolve the contaminating substance adhering to the metal material and the surface layer of the matrix metal by virtue of the oxydative force created by the conversion of the metal ion in a high-oxydation state to the metal ion in low-oxidation state thereby to effect removal of the contaminating substance. In the separating step 16, since radioactivated insoluble substances are sedimented or suspended in the used decontaminating liquid after the treatment of decontamination has been carried out for a certain length of time, the insoluble substances are separated and recovered from the use dencontaminating liquid as by filtration or centrifugation. In the regenerating step 18, an anode and a cathode are immersed in the used decontaminating liquid remaining after the separation and removal of the insoluble substances in the same manner as in the aforementioned electrolytic step 12 and a voltage of a prescribed current density is applied between the electrodes to permit the metal ion in a low-oxidation state reduced at the anode to be regenerated into a metal ion in a high-oxidation state.

EXAMPLE 1

In this example, cerium was selected as a metal assuming a high-oxidation state in an aqueous solution and cerous nitrate, $Ce(NO_3)_3$, a trivalent compound, was selected as a metal compound in a low-oxidation state. It is important that the trivalent cerium compound should be easily soluble in water or an acid. Nitric acid solution was used as an acidic solution for dissolving therein the cerous nitrate. In an apparatus constructed as illustrated in FIG. 1, an oxidative solution 2 containing cerous nitrate in a concentration of 0.8 mol/liter and nitric acid in a concentration of 2.0 mol/liter was placed in an electrolytic cell 1 and an anode 3 comprising a titanium substrate and a platinum coating and a cathode 4 comprising a titanium substrate and a platinum coating were immersed in the oxidative solution. Then, a voltage was applied between the two electrodes to cause passage of an electric current at a density of 0.2 $A/cm^2$ and consequent formation of a decontaminating liquid 6.

Owing to this passage of the electric current, in the acidic solution (decontaminating liquid) having the trivalent salt of cerium dissolved therein, an electrolytic oxidation represented by the following chemical formulas ensued to effect conversion of trivalent cerium ion ($Ce^{3+}$) into tetravalent cerium ion ($Ce^{4+}$).

(Anode)

$$Ce^{3+} \rightarrow Ce^{4+} + e^- \quad (1)$$

$$2OH^- \rightarrow H_2O + (\tfrac{1}{2})O_2(\uparrow) + 2e^- \quad (2)$$

(Cathode)

$$H^+ + e^- \rightarrow (\tfrac{1}{2})H_2(\uparrow) \quad (3)$$

$$Ce^{4+} + e^- \rightarrow Ce^{3+} \quad (4)$$

The tetravalent cerium ion ($Ce^{4+}$) formed as indicated by the aforementioned formula (1) possessed an extremely high oxidative force. Then, the aforementioned decontaminating liquid 6 was placed in the decontaminating cell 5 and brought into contact with a radioactivated metal waste 7. As a result, the radioactivated contaminating substance and the surface layer was dissolved out of the matrix metal material. The reaction proceeded as indicated by the following formula, wherein M stands for the metal.

$$M + Ce^{4+} \rightarrow M^+ + Ce^{3+} \quad (5)$$

In the experiment of Example 1 described above, the reaction of catalytic oxidation caused by the voltage applied between the electrodes produced tetravalent cerium ion efficiently near the anode. Incidentally at the anode, the reaction for forming the tetravalent cerium ion and the reaction for generating oxygen competed with each other. If a metallic material of a low oxygen overvoltage as iron is used for the anode, since the proportion of electric current spent in generating oxygen is higher than that of electric current spent in forming the tetravalent cerium ion, the current efficiency in the formation of the tetravalent cerium ion is lowered. It is, therefore, important that the anode should be made of a metallic material sparingly capable of generating oxygen, i.e. a metallic material of high oxygen overvoltage. In the meantime, on the surface of the cathode, the reaction for forming hydrogen and the reaction for reducing tetravalent cerium ion into trivalent cerium ion competed with each other. If a metallic material of a high hydrogen overvoltage such as mercury is used for the cathode, since the proportion of electric current spent in forming the trivalent cerium ion is higher than that of electric current spent in forming hydrogen, the current efficiency in the formation of the tetravalent cerium ion is lowered. It is, therefore, important that the cathode should be made of a metallic material capable of readily generating hydrogen, i.e. a metallic material of a low hydrogen overvoltage.

Table 1 shows the results of the measurement of current efficiency in the formation of tetravalent cerium ion as obtained in Example 1 and in a comparative experiment embodying the conventional method. In the comparative experiment, the anode was made of tiatanium and the cathode was made of stainless steel. The electric current efficiency in the formation of the tetravalent cerium ion was calculated as follows:

$\eta = [96485 \times \text{amount of } Ce^{4+} \text{ formed (mol/liter)} \times \text{amount of electrolyte (liter)}]/[\text{Time of electrolysis (sec)} \times \text{electric current (A)}]$

TABLE 1

| Materials of anode and cathode | Current efficiency in formation of tetravalent cerium ion (%) |
|---|---|
| Anode - Platinum coating<br>Cathode - Platinum coating<br>(Example 1) | 44.8 |
| Anode - Titanium<br>Cathode - Stainless steel<br>(Comparative experiment) | 29.9 |

It is noted from Table 1 that the current efficiency in the formation of tetravalent cerium ion obtained in Example 1 was about 1.5 times that obtained in the comparative experiment. This is because the anode was made of a metallic material of a low oxygen overvoltage and, as a result, the formation of tetravalent cerium ion occurred less easily and the proportion of electric current spent in the formation of oxygen was higher than that spent in the formation of tetravalent cerium ion. This is also because the cathode was made of a metallic material of a high hydrogen overvoltage and, as a result, the proportion of tetravalent cerium ion converted into trivalent cerium ion increased and the proportion of electric current spent in the formation of hydrogen was decreased.

As described above, in Example 1, the proportion of electric current spent in the formation of tetravalent cerium ion was greater than that for the formation of oxygen and the tetravalent cerium ion was efficiently formed because the anode used was made of a metallic material of high oxygen overvoltage.

In Example 1, cerous nitrate, $Ce(NO_3)_3$, was used as a trivalent cerium compound. Optionally, cerous sulfate, $Ce_2(SO_4)_3$, ammonium cerous nitrate, $Ce(NO_3)_3 \cdot 2(NH_4NO_3)$, cerium carbonate, $Ce_2[(CO_3)_3]$, or cerium oxalate, $Ce_2(C_2O_4)_3$, may be used in the place of cerous nitrate. In the place of the concentration, 0.8 mol/liter, used in Example 1, the concentration of the trivalent cerium compound may be selected freely in the range of 0.01 to 2.0 mol/liter. As the acidic solution having dissolved therein a metal compound in the low-oxidation state, sulfuric acid solution, carbonic acid solution, or oxalic acid solution may be used in the place of the nitric acid solution. In the place of the concentration, 2.0 mol/liter, the concentration of the acidic solution may be freely selected in the range of 0.01 to 10.0 mol/-liter. As the anode, a composite comprising a substrate of any metal other than platinum and titanium and a platinum coating may be used in the place of the composite comprising a titanium substrate and a platinum coating. By the same token, as the cathode, a composite comprising a substrate of any metal other than platinum and titanium and a platinum coating, a composite comprising a substrate of any metal other than platinum and titanium and a platinum coating, a composite comprising a substrate of gold or titanium and a gold coating, or a composite comprising a titanium substrate of any metal other than titanium and a gold coating may be used in the place of the compsite comprising a titanium substrate and a platinum coating. In the place of the current density, 0.2 A/cm$^2$, the current density of the voltage applied between the two electrodes may be freely selected in the range of 0.05 to 2.0 A/cm$^2$.

EXAMPLE 2

In Example 2, an apparatus constructed as illustrated in FIG. 1 was used, chromium was selected as a metal assuming a high-oxidation state in an aqueous solution, and chromic sulfate, $Cr_2(SO_4)_3$, a trivalent chromic compound was used as a metal compound in a low-oxidation state. It is necessary that the trivalent chromic compound should be readily soluble in water or an acid. A sulfuric acid solution was used as an acidic solution for dissolving the chronic sulfate. In an acidic solution containing chromic sulfate in a concentration of 0.1 mol/liter and sulfuric acid in a concentration of 1.0 mol/liter, an anode comprising a substrate of lead dioxide and a platinum coating and a cathode comprising a substrate of titanium and a platinum coating were immersed. A voltage was applied between the two electrodes so as to cause passage of an electric current at a density of 0.1 A/cm$^2$.

In the acidic solution having dissolved therein the trivalent salt of chromium, a reaction of electrolytic oxidation indicated by the following formulas resuluted to effect conversion of the trivalent chromiun ion ($Cr^{3+}$) into bichromate ion ($Cr_2O_7^{2-}$).

(anode)

$$2Cr^{3+}+7H_2O \rightarrow Cr_2O_7^{2-}+14H^++6e^- \quad (6)$$

$$2OH^- \rightarrow H_2O+(\tfrac{1}{2})O_2(\uparrow)+2e^- \quad (7)$$

(Cathode)

$$H^++e^- \rightarrow (\tfrac{1}{2})H_2(\uparrow) \quad (8)$$

$$Cr_2O_7^{2-}+14H^++6e^- \rightarrow 2Cr^{3+}+7H_2O \quad (9)$$

The bichromate ion ($Cr_2O_7^{2-}$) formed by the reaction of the formula (6) had an extremely high oxidative force such that, on contact with the metal material subjected to decontamination, caused dissolution of a radioactive contaminating substances and the surface layer from the matrix metal material. This reaction proceeded as shown by the following formula, wherein M stands for the metal material.

$$M+(1/6)Cr_2O_7^{2-}+(7/3)H^+ \rightarrow M-+(\tfrac{1}{3})Cr^{3+}+(7/6)H_2O \quad (10)$$

In Example 2, owing to the reaction of electrolytic oxidation caused by the voltage applied between the two electrodes, the reaction for forming the bichromate ion and the reaction for forming oxygen competed with each other near the anode. If a metallic material of a low oxygen overvoltage such as iron is used as anode, since the proportion of electric current spent in the formation of oxygen is higher than that spent in the formation of bichromate ion, the current efficiency in the formation of bichromate ion is lowered. It is, therefore, important that the anode should be made of a metallic material or oxide metal material sparingly capable of forming oxygen, i.e. a metallic material or oxide metal material of a high oxygen overvoltage. In the meantime, on the surface of the cathode, the reaction for the formation of hydrogen and the reaction for reducing for reducing bichromate ion into trivalent chromium ion competed with each other. If a metallic material of a high hydrogen overvoltage such as mercury is used for the cathode, the proportion of electric current spent in the formation of trivalent chromium ion is higher than that spent in the formation of hydrogen and, as a result, the current efficiency in the formation of bichromate ion is lowered. It is, therefore, important that the cathode should be made of a metallic material capable of readily forming hydrogen, i.e. a metallic material having a low hydrogen overvoltage.

Table 2 shows the results of the measurement of current efficiency in the formation of bichromate ion as obtained in Example 2 and in a comparative experiment embodying the conventional method. In the comparative experiment, titanium was used for the anode and stainless steel for the cathode. The current efficiency in the formation of bichromate ion was calculated by the following formula:

$\eta$=[96485×amount of $Cr_2O_7^{2-}$ formed (mol/liter)-×amount of electrolytic solution (liter)]/[time of electrolysis (sec)×electric current (A)]

TABLE 2

| Material of anode and cathode | Current efficiency in formation of bichromate ion (%) |
|---|---|
| Anode - Lead dioxide<br>Cathode - Platinum coating<br>(Example 2) | 52.6 |
| Anode - Titanium<br>Cathode - Stainless steel<br>(Comparative experiment) | 4.9 |

It is noted from Table 2 that the current efficiency in the formation of bichromate ion obtained in Example 2 was about 11 times that obtained in the comparative experiment. This is because the anode was made of a metallic material of a low oxygen overvoltage and, as a result, the formation of bichromate ion occurred less easily and the proportion of electric current spent in the formation of oxygen was higher than that spent in the formation of bichromate ion. This is also because the cathode was made of a metallic material of a high hydrogen overvoltage and, as a result, the proportion of bichromate ion converted into trivalent chromium ion increased and the proportion of electric current spent in the formation of hydrogen was decreased.

As described above, in Example 2, the proportion of electric current spent in the formation of bichromate ion was greater than that for the formation of oxygen and the bichromate ion was efficiency formed because the anode used was made of a metallic oxide material of a high oxygen overvoltage.

In Example 2, as the trivalent chromiun compound, chromic nitrate, $Cr(NO_3)_3$ or chromium hydroxide, $Cr(OH)_3$, may be used in the place of chromic sulfate, $Cr_2(SO_4)_3$. In the place of the concentration, 0.1 mol/-liter, the concentration of the trivalent chromium compound may be selected freely from the range of 0.01 to 1.0 mol/liter. As the acidic solution having dissolved therein a metal compound in the low-oxidation state, nitric acid solution, hydrochloric acid solution may be used in the place of the sulfuric acid solution. In the place of the concentration, 1.0 mol/liter, the concentration of the acidic solution may be freely selected in the range of 0.01 to 10.0 mol/liter. As the anode, lead may be used in the place of lead dioxide. By the same token, as the cathode, a composite comprising a substrate of titanium and a platinum coating, a composite comprising a substrate of gold or titanium and a gold coating, or a comprising a substrate of any metal other than titanium and a gold coating may be used instead. In the place of the current density, 0.1 $A/cm^2$, the current density of the voltage applied between the two electrodes may be freely selected in the range of 0.01 to 1.0 $A/cm^2$.

EXAMPLE 3

In Example 3, vanadium was selected as a metal assuming a high-oxidation in state in an aqueous solution and vanadyl sulfate, $VOSO_4$, a tetravalent vanadium compound, was selected as a metal compound in a low-oxidation state. It is important that the tetravalent vanadium compound should be easily soluble in water or an acid. A nitric acid solution was used as an acidic solution for dissolving therein the vanadyl sulfate. In an oxidative solution containing vanadyl sulfate in a concentration of 0.2 mol/liter and sulfuric acid in a concentration of 4.0 mol/liter, an anode comprising a titanium substrate and a platinum coating and a cathode comprising a titanium substrate and a platinum coating were immersed. Then, a voltage was applied between two electrodes to cause passage of an electric current at a density of 0.3 $A/cm^2$ and consequent formation of a decontaminating liquid.

Owing to this passage of the electric current, in the acidic solution having the tetravalent salt of vanadium dissolved therein, an electrolytic oxidation represented by the following chemical formulas ensued to effect conversion of vanadyl ion ($VO^{2+}$) into pervanadyl ion ($VO_2^+$).

(Anode)

$$VO^{2+} + H_2O \rightarrow VO_2^+ + 2H^+ + e^- \quad (11)$$

$$2OH^- \rightarrow H_2O + (\tfrac{1}{2})O_2(\uparrow) + 2e^- \quad (12)$$

(Cathode)

$$H^+ + e^- \rightarrow (\tfrac{1}{2})H_2(\uparrow) \quad (13)$$

$$VO_2^+ + 2H^+ + 3^- \rightarrow VO^{2+} + H_2O \quad (14)$$

The pervanadyl ion ($VO_2^+$) formed as indicated by the aforementioned formula (11) possessed an extremely high oxidative force. Then, the aforementioned decontaminating liquid was placed in the decontaminating cell and brought into contact with a radioactivated metal waste. As a result, the radioactive contaminating substance and the surface layer were dissolved out of the matrix metal material. The reaction proceeded as indicated by the following formula, wherein M stands for the metal.

$$M + VO_2^+ + 2H^+ \rightarrow M^+ + VO_2^{2+} + H_2O \quad (15)$$

Table 3 shows the results of the measurement of current efficiency in the formation of pervanadyl ion as obtained in Example 3 and in a comparative experiment embodying the conventional method. In the comparative experiment, the anode was made of titanium and the cathode was made of stainless steel. The electric current efficiency in the formation of the pervanadyl ion was calculated as follows:

$\eta$=[96485×amount of $VO_2^+$+formed (mol/liter)-×amount of electrolyte (liter)/[Time of electrolysis (sec)×electric current (A)]

TABLE 3

| Materials of anode and cathode | Current efficiency in formation of pervanadyl ion (%) |
|---|---|
| Anode - Platinum coating<br>Cathode - Platinum coating<br>(Example 3) | 37.8 |
| Anode - Titanium<br>Cathode - Stainless steel<br>(comparative experiment) | 19.1 |

In the experiment of Example 3 described above, the reaction of effective oxidation caused by the voltage applied between the electrodes produced pervanadyl ion efficiency near the anode. Incidentally at the anode, the reaction for forming the pervanadyl ion and the reaction for generating oxygen competed with each other. If a metallic material of a low oxygen overvoltage as iron is used for the anode, since the proportion of electric current spent in generating oxygen is higher than that of electric current spent in forming the pervanadyl ion, the current efficiency in the formation of the pervanadyl ion is lowered. It is, therefore, important that the anode should be made of a metallic material sparingly capable of generating oxygen, i.e. a metallic material of a high oxygen overvoltage. In the meantime, on the surface of the cathode, the reaction for forming hydrogen and the reaction for reducing pervanadyl ion into vanadyl ion competed with each other. If a metallic material of a high hydrogen overvoltage such as mercury is used for the cathode, since the proportion of electric current spent in forming the vanadyl ion is higher than that of electric current spent in forming hydrogen, the current efficiency in the formation of the pervanadyl ion is lowered. It is, therefore, important that the cathode should be made of a metallic material capable of readily generating hydrogen, i.e. a metallic material of a low hydrogen overvoltage.

It is noted from Table 3 that the current efficiency in the formation of pervanadyl ion obtained in Example 3 was about 2 times that obtained in the comparative experiment. This is because the anode was made of a metallic material of a low oxygen overvoltage and, as a result, the formation of pervanadyl ion occured less easily and the proportion of electric current spent in the formation of oxygen was higher than that spent in the formation of pervanadyl ion. This is also because the cathode was made of a metallic material of a high hydrogen overvoltage and, as a result, the proportion of pervanadyl ion converted into vanadyl ion increased and the proportion of electric current spent in the formation of hydrogen was decreased.

As described above, in Example 3, the proportion of electric current spent in the formation of pervanadyl ion was greater than that for the formation of oxygen and the pervanadyl ion was efficiently formed because the anode used was made of a metallic material of a high oxygen overvoltage.

In Example 3, vanadyl sulfate, ($VOSO_4$), was used as a tetravalent vanadium compound. Optionally, vanadium oxide, $VO_2$, or vanadyl oxalate, $VOC_2O_4$, may be used in the place of vanadyl sulfate. In the place of the concentration, 0.2 mol/liter, the concentration of the tetravalent vanadium compound may be selected freely in the range of 0.01 to 1.0 mol/liter. A nitric acid solution or an oxalic acid solution may be used in the place of the aforementioned metal compound in the low-oxidation state. In the place of the concentration, 4.0 mol/liter, the concentration of the aforementioned oxidative solution may be freely selected in the range of 0.01 to 10.0 mol/liter. As the anode, a composite comprising a substrate of any metal other than platinum and titanium and a platinum coating may be used in the place of the composite comprising a titanium substrate and a platinum coating. As the cathode mentioned above, a composite comprising a substrate of any metal other than platinum and titanium and a platinum coating, a composite comprising a substrate of gold or titanium and a gold coating, or a composite comprising a substrate of any metal other than titanium and a gold coating may be used in the place of the composition composite comprising a titanium substrate and a platinum coating. In the place of the current density, 0.3 A/cm$^2$, the current density of the voltage applied between the two electrodes may be selected freely in the range of 0.05 to 2.0 A/cm$^2$.

EXAMPLE 4

A decontaminating liquid was produced by the electrolytic reaction of an acidic solution of cerous nitrate by folowing the procedure of Example 1 (the electrolyzing step 12 in FIG. 2). In this decontaminating liquid, $Ce^{4+}$ was contained as a metal ion in a high-oxidation state (numeral 13 in FIG. 2). Then, in a decontaminating step 14 described with respect to FIG. 2, a radiation-contaminated metal material was subjected to decontamination.

In the used decontaminating liquid 15 which had included a metal ion, $Ce^{3+}$, in a low-oxidation state in consequence of the decontamination of the metal material, radioactivated insoluble substances were sedimented or suspended. The insoluble substances were recovered from the decontaminating liquid in the separating step 16 as by filtration. The decontaminating liquid 17 remaining after the recovery of the insoluble substances was treated in the regenerating step 18 and returned to the electrolytic step 12, to produce a decontaminating liquid containing $Ce^{4+}$.

In the used decontaminating liquid into which the radioactive substances and the surface layer of the matrix metal material had been dissolved out in the decontaminating step 14, therefore, $Ce^{3+}$ and $Ce^{4+}$ were dissolved in a mixed state. In this decontaminating liquid, the same anode and cathode as used for the formation of $Ce^{4+}$ in Example 1 were immersed. Between the two electrodes, a voltage was applied to effect passage of an electric current at a density of 0.2 A/cm$^2$. At the anode and the cathode, electrolytic oxidation-reduction reactions indicated by the aforementioned formulas (1) through (4) proceeded, with the result that $Ce^{4+}$ were produced at the anode.

In the experiment of Example 4, the reaction of electrolytic oxidation caused by the voltage applied between the electrodes brought about efficient formation of tetravalent cerium ion near the anode. Thus, Example 4 produced the same operation as in Example 1.

Table 4 shows the results of the measurement of current efficiency in the formation of $Ce^{4+}$ as obtained in Example 4 and in a comparative experiment embodying the conventional method. Table 5 shows the results of the measurement of current efficiency in the formation of $Ce^{4+}$ in the regenerating step. The measurement was carried out by following the procedure of Example 1, with necessary modification.

TABLE 4

| Materials of anode and cathode | Current efficiency in formation of tetravalent cerium ion (%) |
|---|---|
| Anode - Platinum coating<br>Cathode - Platinum coating<br>(Experiment of this invention) | 79.2 |
| Anode - Titanium<br>Cathode - Stainless steel<br>(Comparative experiment) | 40.1 |

TABLE 5

| Materials of anode and cathode | Current efficiency in formation of tetravalent cerium ion in regenerating step (%) |
|---|---|
| Anode - Platinum coating<br>Cathode - Platinum coating<br>(Experiment of this invention) | 44.8 |
| Anode - Titanium<br>Cathode - Stainless steel<br>(comparative experiment) | 23.3 |

It is noted from Table 4 and Table 5 that the current efficiency in the formation of tetravalent cerium ion in Example 1 was about 2 times that obtained in the comprative experiment. This is because in the comparative experiment, the anode was made of a metal material in a low oxygen overvoltage and, as a result, the formation of the tetravalent cerium ion occured less easily and the proportion of electric current spent in the formation of oxygen was higher than that spent in the formation of the tetravalent cerium ion. This is also because the cathode was made of a metal material in a high hydrogen overvoltage and, as a result, the proportion of the tetravalent cerium ion converted into a trivalent cerium ion was increased and the proportion of electric current spent in the formation of hydrogen was decreased.

As described above, in Example 4, since the anode was made of a material having a high oxygen overvoltage, the proportion of electric current spent in the formation of the tetravalent cerium ion was greater than that spent in the formation of oxygen and the tetravalent cerium ion was formed efficiency.

Optionally, the experiment of Example 4 could be carried out by following the procedure of Example 1, with necessary modification.

EXAMPLE 5

In Example 5, a metal compound of a high-oxidation state was used as a metal capable of assuming a high-oxidation state in an aqueous solution. Cerium was selected as a metal in a high-oxidation state ammonium ceric nitrate, $Ce(NO_3)_4.2(NH_4NO_3)$, a tetravalent cerium salt, was used as a metal compound in a high oxidation state. It is important that the tetravalent cerium compound should be a compound readily soluble in water or an acid. As an acidic solution for dissolving the aforementioned ammonium cerous nitrate, a nitric acid solution was used. When a contaminated metal material was immersed in a decontaminating liquid containing the aforementioned cerous nitrate-ammonium salt in a concentration of 0.8 mol/liter and nitric acid in the concentration of 2.0 mol/liter, a reaction represented by the aforementioned formula (5) occurred to dissolve the radiation-contaminating substance and the surface layer from the surface of the matric metal material. Since the used decontaminating liquid remaining after the decontamination of the metal material had sedimented or suspended therein radioactivated insoluble substances, these insoluble substances were recovered from the decontaminating liquid as by filtration.

Now, the operation of the $Ce^{3+}$ reduced in the regenerating step will be described.

In the used decontaminating liquid into which the radioactive substance and the surface layer of the matric metal material had been dissolved out, $Ce^{3+}$ and $Ce^{4+}$ were dissolved in a mixed state. The same anode and the cathode as used in Example 4 were immersed in this used decontaminating liquid. Between the two electrodes mentioned above, a voltage was applied to effect flow of an electric current in a density of 0.2 A/cm$^2$. At the anode and the cathode, the electrolytic oxidation-reduction reactions indicated by the aformentioned formulas (1) through (4) occurred and the regeneration of $Ce^{3+}$ to $Ce^{4+}$ was effected at the anode.

In the experiment of Example 5, owing to the reaction of electrolytic oxidation caused by the voltage applied between the two electrodes, the formation of tetravalent cerium ion efficiently proceeded near the anode.

Table 6 shows the results of the measurement of the course of regeneration as obtained in Example 1 and in a comparative experiment embodying the convetional method.

The measurement was carried out by the procedure of Example 1 with necessary modifications.

TABLE 6

| Materials of anode and cathode | Current efficiency in formation of tetravalent cerium ion during the regeneration step (%) |
|---|---|
| Anode - Platinum coating<br>Cathode - Platinum coating<br>(Example 5) | 41.5 |
| Anode - Titanium<br>Cathode - Stainless steel<br>(comparative experiment) | 21.2 |

It is noted from Table 6 that the current efficiency in the formation of tetravalent cerium ion in Example 1 was about 2 times that in the comparative experiment. This is because, in the comparative experiment, the anode was made of a metallic material of a low oxygen overvoltage and, as a result, the formation of tetravalent cerium ion occured less easily and the proportion of elecric current spent in the formation of oxygen was higher than that spent in the formation of tetravalent cerium ion. This is also because the cathode was made of a metallic material of a high hydrogen overvoltage and, as a result, the proportion of tetravalent cerium ion converted into trivalent cerium ion was increased and the proportion of electric current spent in the formation of hydrogen was decreased.

As described above, in Example 5, since the anode is made of a metallic material of a high oxygen overvoltage, the proportion of electric current spent in the regeneration of tetravalent cerium ion was higher than that spent in the formation of oxygen and the regeneration of tetravalent cerium ion proceeded efficiently.

In Example 5, ceric sulfate, $Ce(SO_4)_2$ or ammonium ceric sulfate, $Ce(SO_4)_2.2(NH_4)_2SO_4$, may be used in the place of ammonium ceric nitrate, $Ce(NO_3)_4.2(NH_4NO_3)$ as a tetravalent cerium compound. In the place of the concentration, 0.8 mol/liter, mentioned above, the concentration of the aforementioned trivalent cerium compound may be selected in the range of 0.01 to 2.0 mol/liter. In the place of the concentration, 2.0 mol/liter, mentioned above, the concentration of the aforementioned acidic solution may be selected in the range of 0.01 to 10.0 mol/liter. Further in the place of the current density, 0.2 A/cm$^2$, mentioned above, the current density of the voltage applied between the two electrodes may be selected in the range of 0.05 to 2.0 A/cm$^2$.

Optionally, the experiment of Example 5 may be carried out by following the procedure of Example 1, with necessary modifications.

EXAMPLE 6

A decontaminating liquid was produced by subjecting an acidic solution of chromic sulfate to electrolysis by following the procedure of Example 2, with necessary modifications. Then, a contaminated metal material was subjected to decontamination by following the procedure of Example 4, with necessary modifications.

In the used decontaminating liquid remaining after the decontamination of the metal material, radioactivated insoluble substances were sedimented or suspended. From the used decontaminating liquid, the insoluble substances were recovered as by filtration to effect regeneration of the decontaminating liquid.

Now, the operation of a typical method adopted for the formation of $Cr^{3+}$ reduced during the regenerating step will be described below.

In the used decontaminating liquid into which the radioactive substances and the surface layer of the matrix material had been dissolved out, $Cr^{3+}$ and $Cr_2O_7^{2-}$ were dissolved in a mixed state. In this used decontaminating liquid, the same anode and cathode as used in the formation of $Cr_2O_7^{2-}$ were immersed and a voltage was applied between the two electrodes to effect passage of an electric current at a density of 0.1 A/cm$^2$. At the anode and the cathode, the electrolytic oxidation-reduction reactions indicated by the aforementioned formulas (6) through (9) occured and the formation of $Cr_2O_7^{2-}$ from $Cr^{3+}$ occured at the anode.

In accordance with the mentioned adopted in Example 6, the reaction of electrolytic oxidation caused by the voltage applied between the two electrodes allowed the formation of bichromate ion near the anode to proceed efficiently. As a result, the same operation as described in Example 2 was brought about.

Table 7 shows the results of the measurement of current efficiency in the formation of $Cr_2O_7^{2-}$ as obtained in Example 6 and in a comparative experiment embodying the conventional method. Table 8 shows the results of the measurement of current efficiency in the formation of $Cr_2O_7^{2-}$ as obtained during the regenerating step. The measurement was made by following the procedure of Example 2, with necessary modifications.

TABLE 7

| Materials of anode and cathode | Current efficiency in formation of bichromate ion ion (%) |
|---|---|
| Anode - Lead dioxide<br>Cathode - Platinum coating<br>(Example 6) | 52.6 |
| Anode - Titanium<br>Cathode - Stainless steel<br>(Comparative experiment) | 4.9 |

TABLE 8

| Materials of anode and cathode | Current efficiency in formation bichromate ion during the regeneration step (%) |
|---|---|
| Anode - Lead dioxide<br>Cathode - Platinum coating<br>(Example 6) | 38.4 |
| Anode - Titanium<br>Cathode - Stainless steel<br>(Comparative experiment) | 3.9 |

It is noted from Table 7 and Table 8 that the current efficiency in the formation of bichromate ion in Example 6 was about 11 times that in the comparative experiment. This is because in the comparative experiment, the anode was made of a metallic material of a low oxygen overvoltage and, as a result, the formation of bichromate ion occurred less easily and the proportion of electric current spent in the formation of oxygen was higher than that spent in the formation of bichromate ion. This is also because the cathode was made of a metallic material of a high hydrogen overvoltage and, as a result, the proportion of bichromate ion converted into trivalent chromium ion was increased and the proportion of electric current spent in the formation of hydrogen was decreased.

As described above, in Example 6, since the anode was made of metallic oxide material of a high oxygen overvoltage, the proportion of electric current spent in the formation of bichromate ion was higher than that spent in the formation of oxygen and the formation of bichromic acid proceeded efficiently.

Optionally, the experiment of Example 6 may be carried out by following the procedure of Example 2, with necessary modifications.

EXAMPLE 7

Example 7 represents a case wherein a metal compound of a high oxidation state was used as the metal capable of assuming a high oxidation state in an aqueous solution. To be specific, chromium was selected as the metal possessing a high-oxidation state and potassium bichromate, $K_2Cr_2O_7$, which is a hexavalent salt of chromium, was used as the metal compound in a high-oxidation state. It is necessary that the hexavalent chromium compound should be readily soluble in water or an acid. A sulfuric acid solution was used as the acidic solution for dissolving the aforementioned potassium bichromate. When a contaminated metal material was immersed in the decontaminating liquid containing potassium bichromate in a concentration of 0.1 mol/liter and sulfuric acid in a concentration of 1.0 mol/liter, there ensued a reaction indicated by the aforementioned folmula (10), with the result that the radioactive substance and the metal layer were dissolved out of the surface layer of the metal material. In the used decontaminating liquid remaining after the decontamination of the material, radioactivated insoluble substances were sedimented or suspended. Thus, by recovering these insoluble substances as by filtration, the used decontaminating liquid was regenerated.

The operation of the method adopted for the formation of $Cr^{3+}$ reduced during the regenerating step was substantially the same as that of Example 6.

Table 9 shows the results of the measurement of current density in the formation of bichromate ion as obtained in Example 7 and in a comparative experiment embodying the conventional method.

The measurement was carried out by following the procedure of Example 6, with necessary modifications.

TABLE 9

| Materials of anode and cathode | Current efficiency in formation of bichromate ion during the regenerating step |
|---|---|
| Anode - Lead dioxide<br>Cathode - Platinum coating<br>(Example 7) | 37.6 |
| Anode - Titanium<br>Cathode - Stainless steel<br>(Comparative experiment) | 3.7 |

It is noted from Table 9 that the current efficiency in the formation of hexavalent chromium ion in Example 7 was about 10 times that in a comparative experiment embodying the conventional method. This is because in the comparative experiment, the anode was made of a metallic material of a low oxygen overvoltage and, as a result, the formation of hexavalent chromium ion occured less easily and the proportion of electric current spent in the formation of oxygen was higher than that spent in the formation of hexavalent chromium ion. This is also because the cathode was made of a metallic material of a high hydrogen overvoltage and, as a result, the proportion of hexavalent chromium ion converted into trivalent chromium ion was increased and the proportion of electric current spent in the formation of hydrogen was decreased.

As described above, in the present example, since the anode was made of a metallic oxide material of a high oxygen overvoltage, the proportion of electric current spent in the formation of hexavalent chromium ion was higher than that spent in the formation of oxygen and the regeneration of hexavalent chromium ion proceeded efficiently.

In Example 7, potassium bichromate, $KCrO_4$, or chromium trioxide, $CrO_3$, may be used in the place of potassium bichromate, $K_2Cr_2O_7$, as a hexavalent chromium compound. In the place of the concentration, 0.1 mol/liter, mentioned above, the concentration of the aforementioned hexavalent chromium compound may be selected in the range of 0.01 to 1.0 mol/liter. In the place of the sulfuric acid solution mentioned above, the acidic solution for dissolving the metal compound of a high-oxidation state may be a nitric acid solution or a hydrochloric acid solution. Further, in the place of the concentration 1.0 mol/liter, mentioned above, the concentration of the aforementioned acidic solution may be selected in the range of 0.01 to 10.0 mol/liter.

In the place of the current density, 0.1 $A/cm^2$, mentioned above, the current density of the voltage applied between the two electrodes may be selected in the range of 0.01 to 1.0 A/cm$^2$.

EXAMPLE 8

A decontaminating liquid was produced by following the procedure of Example 3, with necessary modifications. Then, a contaminated metal material was decontaminated by following the procedure of Example 4, with necessary modifications.

In the used decontaminating liquid remaining after the decontamination of the metal material, radioactivated insoluble substances were sedimented or suspended. The used decontaminating liquid, therefore, was regenerated by recovering the insoluble substances as by filtration. Now, the operation of the method adopted for the formation of $VO^{2+}$ reduced during the regenerating step will be described below.

In the decontaminating liquid into which the radioactive contaminating substance and the surface layer of the matric metal material had been dissolved out, $VO^{2-}$ and $VO_2^+$ were dissolved in a mixed state. In this decontaminating liquid, the same anode and cathode as used in Example 3 were immersed. A voltage was applied between the aforementioned two electrodes to effect passage of an electric current in a density of 0.3 A/cm$^2$. At the anode and the cathode, electrolytic oxidation-reduction reactions indicated by the aforementioned formulas (11) through (14) ensued and the formation of $VO_2^+$ from $VO^{2+}$ occured at the anode.

In accordance with the method used in Example 8 for the production of the deconaminating liquid, the reaction of electrolytic oxidation caused by the voltage applied between the two electrodes enabled the formation of pervanadyl ion near the anode to proceed efficiently.

As a result, there was brought about the same operation as in Example 3.

Table 10 shows the results of the measurement of current efficienty in the formation of $VO_2^+$ as obtained in Example 1 and a comparative experiment embodying the conventional method. Table 11 shows the results of the measurement of current efficiency in the formation of $VO_2^+$ during the regenerating step.

TABLE 10

| Materials of anode and cathode | Current efficiency in formation of pervanadyl ion (%) |
|---|---|
| Anode - Platinum coating<br>Cathode - Platinum coating<br>(Example 8) | 37.8 |
| Anode - Titanium<br>Cathode - Stainless steel<br>(Comparative experiment) | 19.1 |

TABLE 11

| Materials of anode and cathode | Current efficiency in formation of pervanadyl ion during the regenerating step |
|---|---|
| Anode - Platinum coating<br>Cathode - Platinum coating<br>(Example 8) | 20.1 |
| Anode - Titanium<br>Cathode - Stainless steel<br>(Comparative experiment) | 9.8 |

It is noted from Table 10 and Table 11 that the current efficiency in the formation of pervanadyl ion in Example 8 was about 2 times that in the comparative experiment. This is because in the comparative experiment, the anode was made of a metallic material of a low oxygen overvoltage and, as a result, the formation of pervanadyl ion occured less easily and the proportion of electric current spent in the formation of oxygen was greater than that spent in the formation of oxygen was greater than that spent in the formation of pervanadyl ion.

This is also because the cathode was made of a metallic material of a high hydrogen overvoltage and, as a result, the proportion of pervanadyl ion converted into vanadyl ion was increased and the proportion of electric current spent in the formation of hydrogen was decreased.

As described above, in Example 8, since the anode was made of a metallic material of a high oxygen overvoltage, the proportion of electric current spent in the formation of pervanadyl ion was higher than that spent in the formation of oxygen and the formation of pervanadyl ion proceeded efficiently.

EXAMPLE 9

Example 9 represents a case wherein a metal compound in a high-oxidation state was used as a metal assuming a high-oxidation state in an aqueous solution. Specifically, vanadium was selected as a metal assuming a high-oxidation state and pervanadyl sulfate, $(VO_2)_2SO_4$, which is a pentavalent vanadium salt, was used as the metal compound in a high-oxidation state. It is necessary that the pentavalent vanadium compound should be readily soluble in water or an acid. A sulfuric acid solution was used as an acidic solution for dissolving the aforementioned pervanadyl sulfate. When a contaminated metal material was immersed in the decontaminating liquid containing the aforementioned pervanadyl sulfate in a concentration of 0.1 mol/liter and sulfuric acid in a concentration of 4.0 mols/liter, there ensued a reaction indicated by the aforementioned formula (15), with the result that the radio-active contaminating substance and the surface layer were dissolved out of the surface layer of the matrix metal material.

In the used decontaminating liquid remaining after the decontamination of the metal material, radioactivated insoluble sustances were sedimented or suspended. The used decontaminating liquid, therefore, was regenerated by recovering the insoluble substances from the liquid as by filtration.

Now, the operation of $VO^{2+}$ reduced during the regenerating step will be described below.

In the decontaminating liquid into which the radioactive contaminating substance and the surface layer of the matric metal material had been dissolved out, $VO^{2+}$ and $VO_2^+$ were dissolved in a mixed state. In this decontaminating liquid, the same anode and cathod as used in Example 8 were immersed. A voltage was applied between the two electrodes to effect passage of an electric current at a density of 0.3 A/cm$^2$. At the anode and the cathode, the reactions of elctrolytic oxidation and reduction indicated by the aforementioned formulas (11) through (14) ensued and the formation of $VO_2^+$ from $VO^{2+}$ occurred at the anode.

In Example 9, the reaction of electrolytic oxidation caused by the voltage applied between the two electrodes enabled the regeneration of pervanadyl ion near the anode to proceed efficiently.

Table 12 shows the results of the measurement of current efficiency in the formation of pervanadyl ion as obtained in Example 9 and in a comparative experiment embodying the conventional method.

The measurement was carried out by following the procedure of Example 3, with necessary modifications.

TABLE 12

| Materials of anode and cathode | Current efficiency in formation of pervanadyl ion during the regeneration step (%) |
|---|---|
| Anode - Platinum coating<br>Cathode - Platinum coating<br>(Example 9) | 19.8 |
| Anode - Titanium<br>Cathode - Stainless steel<br>(Comparative experiment) | 9.7 |

It is noted from Table 12 that the current efficiency in the formation of pervanadyl ion in Example 9 was about 2 times that obtained in the comparative experiment. This is because in the comparative experiment, the anode was made of a metallic material of a low oxygen overvoltage and, as a result, the formation of pervanadyl ion occurred less easily and the proportion of electric current spent in the formation of oxygen was higher than that spent in the formation of pervanadyl ion. This is also because the cathode was made of a metallic material of a high hydrogen overvoltage and, as a result, the proportion of pervanadyl ion converted into vanadyl ion was increased and the proportion of electric current spent in the formation of hydrogen was decreased.

As described above, in Example 9, since the anode was made of a metallic material of a high oxygen overvoltage, the proportion of electric current spent in the formation of pervanadyl ion was higher than that spent in the formation of oxygen and the regeneration of pervanadyl ion proceeded efficiently.

In the place of pervanadyl sulfate, $(VO_2)_2SO_4$, vanadium pentoxide, $V_2O_5$, may be used as the pentavalent vanadium compound in Example 9. In the place of the concentration, 0.1 mol/liter, mentioned above, the concentration of the pentavalent vanadium compound may be selected in the range of 0.01 to 1.0 mol/liter. In the place of the sulfuric acid solution mentioned above, a nitric acid solution may be used as the decontaminating liquid for dissolving the metal compound in a low-oxidation state. In the place of the concentration, 4.0 mol/liter, mentioned above, the concentration of the aforementioned decontaminating liquid may be selected in the range of 0.01 to 10.0 mol/liter.

Further, in the place of the current density, 0.3 $A/cm^2$, mentioned above, the current density of the voltage applied between the two electrodes may be selected in the range of 0.05 to 2.0 $A/cm^2$.

Optionally, the experiment of Example 9 may be carried out by the procedure of Example 3, with necessary modifications.

The temperature of the acidic solution may be selected in the range of 15° C. to 90° C.

The present invention brings about the following effects.

(1) The proportion of electric current spent in the reaction for converting a metal ion in a low-oxidation state into a metal ion in a high-oxidation state is increased. In other words, the current efficiency in the reaction of oxidation for converting a metal ion in a low-oxidation state into a metal ion in a high-oxidation state is improved. Further, since the metal ion in a low-oxidation state which has been reduced in contact with the contaminated metal material subjected to decontamination can be regenerated into a metal ion in a high-oxidation state, the amount of secondary waste to be produced during the decontamination can be decreased.

(2) The proportion of electric current in the reaction for converting a metal ion in a high-oxidation state into a metal ion in a low-oxidation state is decreased, and then the proportion of electric current spent in the reaction for the formation of hydrogen increased. In other words, the current efficiency in the reaction of oxidation for converting a metal ion in a low-oxidation state into a metal ion in a high-oxidation state is improved.

(3) Since the cathode is made of a metallic material which is not dissolved out into the acidic solution which has dissolved the metal ion in a high-oxidation state, it is free from the disadvantage of the conventional stainless steel cathode suffering the components thereof to dissolve out in the decontaminating liquid.

(4) Since the reaction of oxidation for converting a metal ion in a low-oxidation state into a metal ion in a high-oxidation state has no use for any oxidizing agent, the amount of secondary waste to be produced is decreased.

(5) Since the radioactivated insoluble substances sedimented or suspended in the decontaminating liquid are recovered as by filtration, the concentration of radiation in the decontaminating liquid can be lowered and the exposure of workers to radiation can be diminished.

We claim:

1. In a process for the removal of radiation-contaminated material from the surface of a metal using a decontaminating liquid, a method for the production of said decontaminating liquid comprising the steps of:

immersing an anode made of a metal or a metal oxide having a high oxygen overvoltage equal to or higher than the oxygen overvoltage of platinum and a cathode made of a metal or a metal oxide having a low hydrogen overvoltage equal to or lower than the hydrogen overvoltage of platinum in an oxidative solution obtained by dissolving in an acidic solution a metal compound in a low-oxidation state of a metal assuming a high-oxidation state in an aqueous solution, wherein said metal compound in a low-oxidation state is a compound of $Ce^{3+}$, $Cr^{3+}$, or $VO^{2+}$ which, on being dissolved in an acidic solution, gives rise in the resultant solution to a metal ion in a low-oxidation state, and causing passage of an electric current between said two electrodes thereby effecting oxidation of a metal ion in a low-oxidation state and consequent formation of a metal ion in a high-oxidation state at said anode, wherein said metal ion in a high-oxidation state is one member selected from the group consisting of $Ce^{4+}$, $Cr_2O_7^{2-}$, and $VO_2^{+}$.

2. A method according to claim 1, wherein said acidic solution contains one member selected from the group consisting of nitric acid, sulfuric acid, hydrochloric acid, carbonic acid, and oxalic acid.

3. A method according to claim 1, wherein the concentration of said acidic solution is in the range of 0.01 to 10.0 mol/liter.

4. A method according to claim 1, wherein the temperature of said acidic solution is in the range of 15° C. to 90° C.

5. A method according to claim 1, wherein said anode made of a metal or a metal oxide having a high oxygen overvoltage equal to or higher than the oxygen overvoltage of platinum is incapable of being dissolved out into said acidic solution having dissolved therein a said metal ion in a high-oxidation state.

6. A method according to claim 1, wherein said cathode made of a metal or a metal oxide having a low hydrogen overvoltage equal to or lower than the hydrogen overvoltage of platinum is incapable of being dissolved out into said acidic solution having dissolved therein said metal ion in a high-oxidation state.

7. A decontaminating liquid recycling process comprising an electrolyzing step of immersing an anode made of a metal or a metal oxide having a high oxygen overvoltage equal to or higher than the oxygen overvoltage of platinum and a cathode made of a metal or a metal oxide having a low hydrogen overvoltage equal to or lower than the hydrogen overvoltage of platinum in an oxidative solution obtained by dissolving in water or an acidic solution a metal compound in a low-oxidation state of a metal assuming a high-oxidation state in an aqueous solution and causing passage of an electric current between said two electrodes thereby effecting oxidation of a metal ion in a low-oxidation state and consequent formation of a metal ion in a high-oxidation state at said anode, a decontaminating step of causing a radiation-contaminated metal material to contact said decontaminating liquid produced during said electrolyzing step thereby removing a contaminating substance adhering to said contaminated metal material and the surface layer of a matrix metal material by virtue of the oxidation force generated during said coversation of said metal ion in said high-oxidation state into a metal ion in a low-oxidation state, a separating step of separating insoluble substances sedimented or suspended in said used decontaminating liquid which has effected removal of said decontaminating substance during said decontaminating step, and a regenerating step of returning said decontaminating liquid containing the metal ion in a low-oxidation state and said metal ion in a high-oxidation state separated during the separating step back to said electrolyzing step, immersing an anode made of a metal or a metal oxide having high oxygen overvoltage equal to or higher than the oxygen overvoltage of platinum and a cathode made of a metal or a metal oxide having a low hydrogen overvoltage equal to or lower than the hydrogen overvoltage of platinum in said returned decontaminating liquid, and causing passage of an electric current between said electrodes thereby oxidizing and regenerating a metal ion in a low-oxidation state into a metal ion in a high-oxidation state at said anode.

8. A method according to claim 7, wherein said metal compound in a low-oxidation state is a compound of $Ce^{3+}$, $Cr^{3+}$, or $VO^{2+}$ which, on being dissolved in water or an acidic solution, gives rise in the resultant solution to a metal ion in a low-oxidation state.

9. A method according to claim 7, wherein said metal ion in a high-oxidation state is one member selected from the group consisting of $Ce^{4+}$, $Cr_2O_7^{2-}$, and $VO_2^{+}$.

10. A method according to claim 7, wherein said acidic solution contains one member selected from the group consisting of nitric acid, sulfuric acid, hydrochloric acid, carbonic acid, and oxalic acid.

11. A method according to claim 7, wherein the concentration of said acidic solution is in the range of 0.01 to 10.0 mol/liter.

12. A method according to claim 7, wherein the temperature of said acidic solution is in the range of 15° C. to 90° C.

13. A method according to claim 7, wherein said anode made of a metal or a metal oxide having a high oxygen overvoltage equal to or higher than the oxygen overvoltage of platinum is incapable of being dissolved out into said acidic solution having dissolved therein said metal ion in a high-oxidation state.

14. A method according to claim 7, wherein said cathode made of a metal or a metal oxide having a low hydrogen overvoltage equal to or lower than the hydrogen overvoltage of platinum is incapable of being dissolved out into said acidic solution having dissolved therein said metal ion in a high-oxidation state.

15. The method according to claim 1, wherein said metal compound in a low-oxidation state is a compound of $Ce^{3+}$ or $VO^{2+}$ which, on being dissolved in an acid, gives rise in the resultant solution to a metal ion in a low-oxidation state.

* * * * *